United States Patent [19]

Thoren

[11] 4,114,334

[45] Sep. 19, 1978

[54] BUILDING COMPONENT

[76] Inventor: Torgny A. Thoren, Nämndemansvägen 23, 191 70 Sollentuna, Sweden

[21] Appl. No.: 808,178

[22] Filed: Jun. 20, 1977

[30] Foreign Application Priority Data

Jun. 24, 1976 [SE] Sweden ..... 7607287

[51] Int. Cl.[2] ..... E04B 1/78

[52] U.S. Cl. ..... 52/303; 52/585

[58] Field of Search ..... 52/303, 585; 98/29, 98/31-34

[56] References Cited

U.S. PATENT DOCUMENTS

| | | | |
|---|---|---|---|
| 2,140,689 | 12/1938 | Collins | 52/303 |
| 2,251,660 | 8/1941 | Chipley | 52/303 |
| 3,318,056 | 5/1967 | Thompson | 52/303 |
| 3,563,582 | 2/1971 | Shroyer | 52/585 |
| 3,789,747 | 2/1974 | Wasserman | 52/303 |

*Primary Examiner*—J. Karl Bell

*Attorney, Agent, or Firm*—Hill, Gross, Simpson, Van Santen, Steadman, Chiara & Simpson

[57] ABSTRACT

A panel building component for use in conjunction with a heat-insulating wall of the type having a porous layer through which a transverse air flow is maintained in a direction opposite to the direction of the temperature gradient. The panel building component comprises a frame and two spaced layers secured to the frame and defining an air space between them. One layer is rigid and impermeable to air flow whereas the other layer has a limited permeability to air flow. The panel building component is mounted as a lining or cladding on the wall with the air-permeable layer in face-to-face engagement with the porous layer of the wall. The air space is adapted to be connected to a fan for maintaining a reduced pressure in the air space to cause external air to flow through the porous layer into the air space.

10 Claims, 8 Drawing Figures

FIG. 1
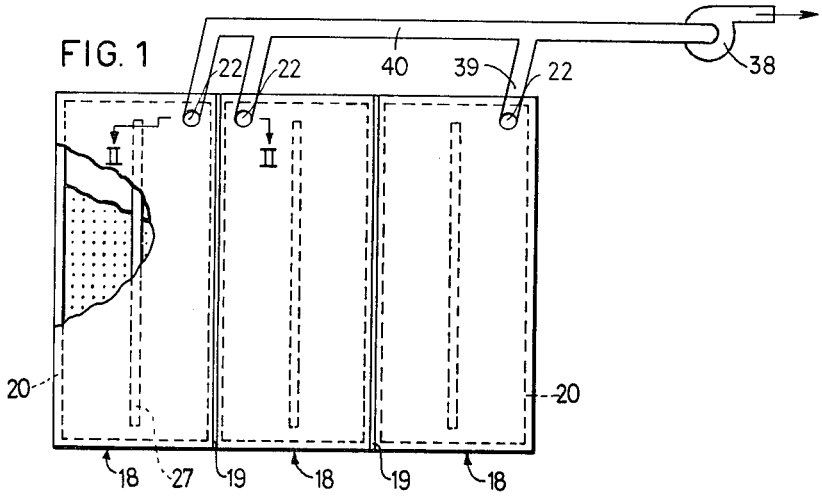
FIG. 2
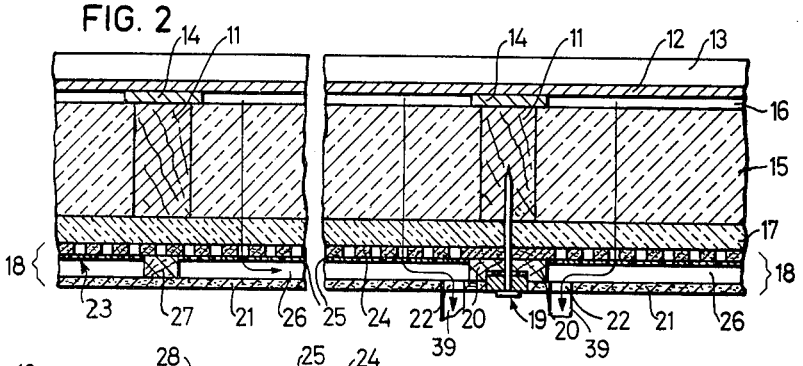
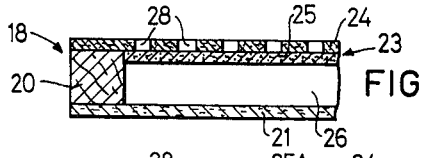
FIG. 3
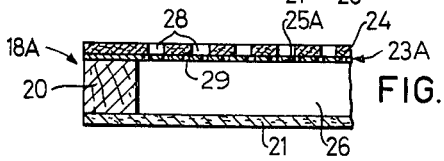
FIG. 4
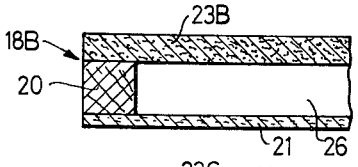
FIG. 5
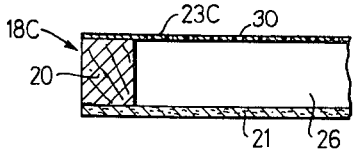
FIG. 6
FIG. 7
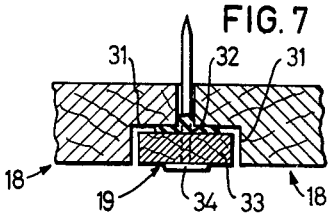
FIG. 8
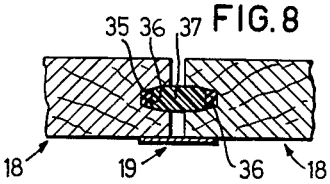

BUILDING COMPONENT

BACKGROUND OF THE INVENTION

1. Field of the Invention

This invention relates to a building component of panel form, that is, a building component having substantially two-dimensional form and used as a surface or skin building component, such as a facade component, internal or external wall component, floor component or roof or ceiling component.

2. Prior Art

U.S. Pat. No. 3,376,834 shows a heat-insulating structure which is useful as a wall, floor or roof or similar building structure. For the purpose of this specification, this known structure is simply termed "wall".

This prior wall comprises a porous, air-permeable layer of heat-insulating material, such as mineral or slag wool. On one or both sides of the porous layer there is a finely perforated sheet, such as a plastic film. When the wall is used to insulate against loss of heat from a room to a space at a lower temperature, a small pressure differential is maintained across the wall to cause air to flow through the porous layer and the perforated sheet from the colder space towards the room, that is, from the colder side towards the warmer side. The finely perforated sheet serves to maintain the pressure differential and to ensure that the air flow is substantially uniformly distributed over the entire area of the wall and passes through the porous layer substantially perpendicularly to the wall.

The inwardly flowing air will be heated by the outwardly directed heat flow and thus will carry at least a part of the outwardly flowing heat back towards the warmer side of the wall. If the air flow is fairly uniformly distributed, it is possible to obtain a very efficient heat insulation even if the porous layer is relatively thin and the air flow and the pressure differential are relatively small, e.g. a flow on the order of 1 cubic meter per hour per square meter of wall area, and a pressure on the order of a few millimeters of water pressure.

In practice, the side of the wall facing the room, the inner side is provided with a layer which is impermeable to air flow and formed of hardboard, for example. This impermeable layer is slightly spaced from the porous layer so that a narrow clearance or air space is formed between the porous layer and the impermeable layer. The air space is connected to a suction fan producing the necessary air flow. Naturally, the outer side of the porous layer also has to be exposed so that the air entering the porous layer can be distributed over the entire area thereof. To this end, the outer side of the wall may have a facade panel which is slightly spaced from the porous layer and which preferably is impermeable to air flow.

In order that the wall may provide the desired heat insulation with minimum size of the fan, it is of course necessary to ensure that all of the air that the fan sucks from the air space at the inner side of the wall passes through the porous layer, that is, to ensure that air can enter the air space only from the space at the outer side of the porous layer. As is readily understood, a crack or a hole in the layer separating the air space from the room may mean that the air is partly or wholly sucked from the room into the air space instead of being sucked exclusively through the porous layer.

It is necessary, therefore, to construct the wall in such a manner as to ensure that the air space remains sealed in airtight manner throughout the life of the wall. For example, displacements caused by distortions of the building or by fluctuations of the moisture content and/or temperature must not destroy the air-tightness.

An efficient production of walls of the above-described kind therefore can only be ensured if the walls are constructed from factory-made standardized units, e.g. of a height equal to room height and a width corresponding to standard widths of building boards. Since such wall units have a thickness equal, or almost equal, to that of the finished wall, the transport from the factory to the building site requires a considerable transportation capacity; during the transport the elements also have to be well protected against mechanical damage. Moreover, such standardized units restrict the options of the building designer.

SUMMARY OF THE INVENTION

The present invention permits an efficient production while avoiding the above-explained drawbacks. The invention is based on the idea that only those parts of the finished wall which define the air space have to be made with such a degree of accuracy and using such equipment that factory-production is necessary, whereas the other parts may be produced in a less demanding manner, e.g. at the building site, without impairing the ability of the finished wall to provide efficient heat insulation.

In accordance with the invention there is provided a building component of panel form having the features recited in claim 1 of the appended claims. The building component according to the invention may also embody one or more of the additional features recited in the dependent claims.

A building component according to the invention comprises a frame, an air-impermeable, relatively rigid layer, e.g. of hardboard, plywood or the like, at one side of the frame and an air-permeable air distribution layer, which may be rigid or flexible, at the other side of the frame. The two layers are spaced and define an air space between them. Moreover, the building component comprises connecting means for connecting the air space with a fan. The layers are sealed to the frame so that air can enter and leave the air space only through the air distribution layer and the connecting means.

When constructing a wall of a building components according to the invention, the building components are mounted, e.g. nailed to a framework of the building, in such a manner that the air distribution layer faces away from the room, whereas the air-impermeable layer faces the interior of the room. The porous layer, which is preferably made of mineral or slag wool or some other suitable heat-insulating material, is provided at the outer side of the air distribution layer in the customary manner, a free air space being left at the outer side of the porous layer so that air can gain unobstructed access to the outer side of the porous layer over the entire area thereof. Moreover, provision is made to ensure that the porous layer lies closely against the air distribution layer so that air cannot flow laterally between the two layers.

The air spaces of the elements are connected to a fan serving to suck outside air through the porous layer of the wall into the air space and then out of the latter. As in the prior wall, the air distribution layer serves to produce a constant pressure differential and a uniform permeability to air over the entire area of the porous layer and thereby to produce a uniform distribution of the air flow over the entire area of the porous layer. The air sucked out of the air space and heated in the porous layer may be used as preheated ventilation air.

The air distribution layer need not necessarily be a single layer but may be a composite layer and have a thickness which is substantial in relation to the total thickness of the building component. It may be made of a material having good heat-insulating properties and in that case contributes to the heat insulation. However, it is not primarily intended to provide heat insulation but to provide a uniform distribution of the air flow through the porous layer.

For convenience of description, it has been assumed here that the wall is an external wall which is used to insulate a room against heat losses to the outside air, that is, it has been assumed that the air flows from the outside to the inside. However, the heat-insulating structure is also useful as a roof or a floor, and it may also be used to insulate a room against undesired heat supply through the wall, the roof or the floor; in case the air flows from the inside and outwardly. Thus, the building component according to the invention is also useful in connection with refrigerated spaces.

The building component according to the invention may advantageously be produced centrally and mounted either at the building site or at a location where complete walls or wall units are made which are then transported to the building site. The transport from a central production plant requires no great transportation capacity, since the thickness of the building component is small in relation to the total thickness of the finished wall.

The building component according to the invention is useful not only in residential or other houses but has general applicability where a heat-insulating wall structure according to the above-mentioned patent may be used. As examples one may take, in addition to residential and other houses, heat treatment and drying ovens, refrigerated cargo holds on ships, and so on.

The invention will now be described in greater detail with reference to the accompanying diagrammatic drawings.

ON THE DRAWINGS

FIG. 1 is an elevational view of a portion of an external room wall comprising building components embodying the invention;

FIG. 2 is an enlarged cross sectional view taken along line II-II of FIG. 1;

FIGS. 3, 4, 5 and 6 are fragmentary cross-sectional views showing a number of exemplary embodiments of building components embodying the invention;

FIGS. 7 and 8 show two examples of joints between adjacent edges of the building components of the wall in FIGS. 1 and 2.

AS SHOWN ON THE DRAWINGS

The wall shown in FIGS. 1 and 2 defines a side of a room which is insulated against heat losses to a colder outer space by means of the wall. FIG. 1 shows the inner side of the wall, that is, the side facing the room.

The wall comprises a framework, which may be conventional with vertical load-carrying wooden posts 11 uniformly spaced by standardized distances. At the outer side of the posts 11 (the upper side in FIG. 2) a wind protection panel 12 is provided, and at the outer side of the panel 12 an external cladding 13, for example wood siding or brick veneer, is provided. Spacers 14 keep the wind protection panel 12 slightly spaced from the posts 11.

Between the posts 11 an outer insulating layer 15 of mineral or slag wool is provided. This layer, which is highly porous, fits snugly with the posts at its vertical edges and is flush with the outer and inner faces of the posts. Thus, between the panel 12 and the porous layer 25 there is an air space 16 to which the outside air has unobstructed access. At the inner side of the porous layer 15, that is, at the side facing the room, there is an inner layer 17 which is likewise made of mineral or slag wool and which is thus porous and permeable to air. However, this inner layer 17, which is substantially thinner than the outer layer 15, is more rigid than the last-mentioned layer and therefore has some load-carrying capability. It is nailed to the inner face of the posts 11 and as shown in FIG. 2 it extends continuously over the entire area of the wall. The inner layer 17 contributes to a uniform air distribution and enables securing of a number of building components 18 to the posts 11 with some degree of relative movement of adjacent components 18 being permissible, while at the same time it prevents the posts 11 from forming a thermal bridge to the building components 18.

A plurality of the panel building components 18, which form the main element of the present invention, are disposed in face-to-face engagement with the inner face of the inner porous layer 17. The building components 18 are disposed side by side in a common plane and are connected with one another through air-tight joints 19 registering with alternate posts 11. The building components 18 extend undivided from the floor to the ceiling and are connected with the floor and the ceiling through horizontal joints similar to the vertical joints 19.

Each building component 18 comprises a rectangular frame 20, an air-impermeable first layer 21 secured to one side, the inner side, of the frame 20 and having an air connection opening 22, and an air-permeable second layer 23 secured to the opposite side (the outer side) of the frame. In the embodiment shown in FIGS. 2 and 3, the second layer 23 is a composite layer made up of two superposed sheets or plies 24 and 25. The second layer 23 forms the above-mentioned air distribution layer, which serves to produce a relatively small but distinct resistance to air flow through the layer and thereby to produce a pressure differential between the air space 16 and an air space 26 defined within the frame 20 between the layers 21 and 23. The layer 23 has to produce a resistance to air flow therethrough which is dependent on the particulars of each individual case, namely, the pressure differential that is suitable or required. In order that the best possible heat-insulating effect may be achieved, the pressure differential between the air spaces 16 and 26 must effect an air flow that is uniformly distributed over the entire area of the porous layers 15 and 17.

Halfway between the two vertical lateral members of the frame 20 there is a vertical spacer or batten 27 extending substantially throughout the height of the building component 18. At the ends of the spacer there are passages permitting substantially unrestricted air flow between the two segments of the air space 26 separated by the spacer. The spacer 27 may be omitted if the width of the building component 18 is smaller than twice the distance between adjacent posts 11. If the building component 18 is very wide, additional spacers may be provided, preferably such that each spacer registers with a post 11.

The spacers 27 may alternatively be dimensioned and arranged such that they divide the air space 26 into a plurality of sealed segments communicating with one another through separate connectors corresponding to the connectors (not shown) inserted in the openings 22. If necessary, the building component can then be divided into narrower units at the building site. Naturally, horizontal spacers may be provided in a similar manner.

The details of the building component 18 are best shown in FIGS. 2 and 3; the latter figure is an enlarged horizontal cross-sectional view of a marginal portion of the building component. The frame 20 is made of wood and glued, or secured in any other suitable manner, between the layers 21 and 23 such that air cannot pass between the faces of the frame and the layers.

The first layer 21 is made of a rigid, imperforate plate, preferably hardboard. The layer has to be air-tight, that is, it must be capable of substantially preventing air from passing through it under the action of the relatively small pressure differentials (on the order of a few millimeters of water pressure) maintained across the layer. Moreover, the layer 21 should have sufficient mechanical strength to withstand a normally rough handling of the building component 18, e.g. during transport and installation, without damage.

The openings 22, through which the air space 26 may be connected to the fan 38 of an air flow system are provided adjacent a corner of the layer 21, within the opening defined by the inner peripheral edge of the frame 20. The connection is effected by means of a tubular connector 39 which is inserted in the opening 22 and sealingly engages the edge defining the opening 22, and which connectors 39 are connected by conduit 40 to the fan 38.

Of the two superposed plies 24 and 25 of the layer 23, the first mentioned ply 24 is formed of a rigid, uniformity perforated plate, such as a hard fiberboard plate, the perforations 28 being relatively large (diameter e.g. 1 to 5 mm, center-to-center spacing e.g. 5 to 20 mm). This plate, like the plate forming the layer 21, covers the entire area of the frame and is perforated at least within an area that is coextensive with the air space 26.

The other ply 25 is formed of a porous fibrous material, such as a soft fiberboard plate, and is glued to the side of the ply 24 facing the air space 26. As shown in FIG. 3, the ply 25 does not cover any part of the faces of the frame 20 but extends up to the inner peripheral edge of the frame.

The ply 24 serves to increase the rigidity of the building component 18 and to form a mechanical protection for the more damageable ply 25. The coarse perforation of the ply 24 provides a practically unobstructed access for the air to the ply 25, and is thus primarily the ply 25 that produces the required pressure differential between the air spaces 16 and 26.

The embodiments shown in FIGS. 4 to 6 differ from the embodiment of FIGS. 1 to 3 only in respect of the air-permeable air distribution layer 23.

In the building component 18A shown in FIG. 4 the air distribution layer 23A likewise comprises two plies, a coarsely perforated ply 24 essentially identical with the ply 24 of FIG. 3, and a coarsely perforated thin ply 25A which engages the side of the ply 24 facing the air space 26. In this case the ply 25A is formed of a plastic film or an aluminum foil which has fine perforations 29 and which is stretched across the opening defined by the frame and is coextensive with the coarsely perforated ply 24 (alternatively the ply 25A may be formed of unperforated thin paperboard, felt or the like). Thus, the ply 25A also covers the face of the frame 20. Disregarding the attachment at the frame and at the spacer 27 (FIG. 1), the ply 25A is not attached to the ply 24, which primarily constitutes a mechanical protection of the ply 25A and also makes the building component 18 rigid.

In order that the air flowing through the coarsely perforated ply 24 may easily be uniformly distributed over the entire area of the ply 25A, that side of the ply 24 which faces the ply 25A is roughened, that is, grooved or provided with other irregularities (not shown) so that the air can flow between the two plies substantially without obstruction, regardless of whether the pressure in the air space 26 is negative or positive.

The air-permeable second layer 23B of the building component 18B shown in FIG. 5 is formed of a single imperforate layer, e.g. of an imperforate porous fiberboard plate. This plate is coextensive with the first layer 21 and accordingly covers the entire frame 20. In this case, the fiberboard plate 23B both produces the pressure differential and the uniform distribution of the air flow and confers the required resistance to distortion on the air-permeable air distribution layer. In most cases the conventional, commercially available porous fiberboard plates can be used without modifications but if necessary the permeability to air can be modified, e.g. reduced by the application of a suitable sealant, such as by spraying.

Disregarding the layer 23B, the building component 18B of FIG. 5 is identical with the above-described building components 18 and 18A.

FIG. 6 shows a building component 18C which is also identical with the above-described building components 18, 18A, 18B except for the air-permeable air distribution layer 23C. Here, this layer is made from a thin, finely perforated film, finely perforated sheet metal, a finely perforated hard fiberboard plate or some other finely perforated thin sheet 23C. Except for the multiplicity of small perforations 30 uniformly distributed over the entire area of the sheet, this sheet is impermeable to air, that is, the perforations 30 confer the desired degree of air permeability or resistance to air flow on the layer 23C.

The sheet 23C also covers the entire frame and thus is coextensive with the layer 21. If the sheet 23C is elastic, e.g. made of a plastic film, it is stretched over the opening defined by the frame so as to resist excessive sagging under the action of the pressure differential.

In all of the above-described exemplary embodiments, the building component 18, 18A, 18B, 18C has a constant thickness and the layers of which the building component is made up likewise are of constant thickness. The total thickness of the building component may be determined mainly by the thickness of the plate or sheet or film materials commercially available as standard materials and by the rigidity the building component must possess; this rigidity is best ascertained by testing. Naturally, the air space 25 must have a certain minimum width to permit unobstructed air flow therethrough, but this requirement is easily met if the total thickness of the building component is selected such that the rigidity requirement is met. In practice, the total thickness of the building component is from 1 to 5 cm.

The joints 19 between the building components 18 have to be sealed to prevent the air forced or sucked through the building components from flowing through the joints instead of flowint exclusively through the porous layers 15 and 17. The joints also have to be able to accomodate some relative movements of the building components, e.g. as a consequence of distortion of the supporting framework of the building, while remaining sealed. FIGS. 7 and 8 show two exemplary embodiments of joints which meet these requirements and also permit a simple installation of the building components.

In the embodiment of FIG. 7, which is also illustrated in FIG. 2, each of the two building components 18 is formed with a rabbet 31 opening towards the room and towards the adjacent building component. The rabbets 31 of the two adjacent building components 18 thus jointly form a groove opening towards the room and having rectangular cross-section. At the narrow gap between the two building components a sealing strip 32 of elastic material is disposed which is clamped to the bottom of the groove by a flat fillet strip 33 having approximately the same width as the groove. The fillet strip 33 is held by nails 34 driven through the fillet strip, the gap between the two building components 18, the porous layer 17 and into the post 11, and it thus clamps the two building components 18 to the porous layer 17 (or the post 11). The building components accordingly have some freedom of vertical and horizontal movement relative to one another and the fillet strip, the elasticity of the sealing strip 32 ensuring that the joint retains its sealed condition.

FIG. 8 shows an alternative embodiment. In this embodiment the building components 18 are provided with grooves 35 in the confronting vertical edges of the frames. A sealing strip 36 of elastic material is disposed at the bottom of the grooves, and the two building components are interconnected through a connecting strip 37 made of, for example, hard fiberboard or plastic, which is inserted in the grooves and sealingly engage the sealing strips 36. On installation of the building components 18, these are pushed together after the sealing strips 36 have been inserted in the grooves 35 (this may be done in connection with the production of the building components) and after the connecting strip 37 has been inserted in the groove of one of the building components. The building components are then secured, e.g. nailed, to the posts 11.

The sealing between the building components on the one hand and the floor and the roof on the other hand may be accomplished in the same manner as the sealing between adjacent building components or in any other suitable manner.

As indicated above, the building components 18 are connected to the air flow system through the openings 22. For example, the building components may be individually connected to a header by way of individual tubular connectors attached at the opening 22 of each building component. However, in most cases it is preferred to connect the building components in groups, e.g. by first interconnecting adjacent building components by a first tubular connector and then connecting this connector to a header.

In the above-described application of the invention, in which a room is insulated against heat losses to the outside space, the air is sucked from the outside through the porous layers 15 and 17 into the air space 26 and from there through the openings 22 to a header conduit of the air flow system. The air may then be introduced in the room as preheated ventilation air. If the room is to be insulated against heat supply from the outside space, the air is moved in the opposite direction.

The foregoing description of the invention makes particular reference to its application to a wall. However, as already mentioned, the invention is applicable not only to walls; it may also be applied to floors and ceilings, for example.

The building component according to the invention may also be mounted on the outer side of the wall. For example, the wall of FIG. 2 may be modified such that it is made up of, counted from the outer side and inwardly, the external cladding 13, the building components 18 (the layer 21 facing the cladding 13), the thin porous layer 17, the posts 11 and the thicker porous layer 15 between the posts, the spacers 14 and finally the air-impermeable layer 12 separated from the posts 11 and the porous layer 15 by the spacers 14 and the air space 16. In this case, the air flows through the building components 18 into the air space 16 and thence into the room.

What I claim is:

1. A panel assembly for use as a component of an insulated building wall, comprising:

(a) a frame defining an opening;

(b) a rigid first layer secured to one side of said frame and covering said opening, said first layer being impermeable to the flow of any air;

(c) a second layer adapted to be disposed against the insulation of the building wall, and having limited permeability to airflow therethrough substantially over its entire area and being secured to the opposite side of said frame, said second layer covering said opening and being spaced from said first layer and defining therewith an airspace; and (d) connection means comprising an opening in said impermeable first layer and adapted to be connected to an airflow system to pass air between said airspace and the airflow system, said airspace being sealed in air-tight fashion except through said second layer and said connection means, whereby air flowing through the insulation can flow simultaneously into an out of said space only through said second layer and said connection means.

2. A panel assembly according to claim 1 in which said two layers engage the opposite sides of the frame and cover substantially all of said sides, whereby said second layer will space said frame from the insulation.

3. A panel assembly according to claim 1 in which said frame is rectangular and opposite edges of the frame are provided with groove means for accommodating elastic jointing members of complemental shape by which the panel assembly may be connected with adjacent similar panel assemblies through a sealed joint.

4. A panel assembly according to claim 1 in which said second layer is an imperforate plate of porous material.

5. A panel assembly according to claim 1 in which said second layer is a composite layer comprising a rigid, coarsely perforated outer plate and an inner ply of porous fiberboard engaging the inner side of said outer layer.

6. A panel assembly according to claim 1 in which said second layer comprises a rigid, coarsely perforated outer plate and a finely perforated film engaging the inner side of said outer plate.

7. A panel assembly according to claim 6 in which the inner side of said outer plate is roughened over substantially its entire area, said film being in tension across said opening defined by the frame.

8. A panel assembly according to claim 1, including therewith a pair of vertical posts, a third layer comprising porous material disposed between said posts, a wind protection panel fixedly disposed at one side of said posts and said third layer in spaced relation to said third layer to define a second air space, a substantially continuous fourth layer comprising insulating material engaging said second layer and fixedly disposed therewith at the other side of said posts and said third layer, said fourth layer being thinner, denser and more rigid than said third layer, whereby a heat-insulating wall is provided

9. A building component comprising:

(a) a wall frame;

(b) a wind protection panel secured to the outer side of said wall frame;

(c) a firm porous insulation panel secured to the inner side of said wall frame;

(d) a panel assembly frame;

(e) a layer having limited permeability to airflow therethrough fixed against the outer side of said panel assembly frame and against the inner side of said firm porous insulation panel;

(f) a rigid layer impermeable to any airflow fixed to the inner side of said panel assembly frame and defining a closed airspace at the outer side of said rigid layer; and (g) connection means communicating directly with said airspace, and adapted to be connected to an airflow system.

10. A building component according to claim 9, including additional porous insulation between said wind protection panel and said firm insulation panel, and spaced from said wind protection panel to define a further airspace.

* * * * *